US005775574A

United States Patent [19]

Whitnell

[11] Patent Number: 5,775,574

[45] Date of Patent: Jul. 7, 1998

[54] SPLIT WALL CARTON

[75] Inventor: Simon Whitnell, Exton, Pa.

[73] Assignee: Dopaco, Inc., Exton, Pa.

[21] Appl. No.: 790,866

[22] Filed: Feb. 3, 1997

[51] Int. Cl.[6] ..... B65D 5/486

[52] U.S. Cl. ..... 229/120.18; 229/117; 229/120.11; 229/164

[58] Field of Search ..... 229/117, 120.11, 229/117.14, 120.18, 164

[56] References Cited

U.S. PATENT DOCUMENTS

| | | | |
|---|---|---|---|
| 2,606,711 | 8/1952 | Forrer . | |
| 2,881,946 | 4/1959 | Bosrock et al. | 229/120.18 |
| 2,998,179 | 8/1961 | Zilles | 229/120.18 |
| 3,130,892 | 4/1964 | Krueger et al. | 229/120.18 |
| 3,199,762 | 8/1965 | Coons | 229/120.18 |
| 3,977,592 | 8/1976 | Gorham | 229/120.18 |
| 4,047,610 | 9/1977 | Stout et al. . | |
| 4,312,446 | 1/1982 | Summers . | |
| 4,398,661 | 8/1983 | Schillinger | 229/120.18 |
| 4,407,442 | 10/1983 | Watson et al. . | |
| 4,489,878 | 12/1984 | Mode . | |
| 5,065,937 | 11/1991 | Ritter | 229/120.18 |
| 5,221,001 | 6/1993 | Eisman . | |

FOREIGN PATENT DOCUMENTS

| | | | |
|---|---|---|---|
| 2573726 | 5/1986 | France | 229/120.18 |
| 2086850 | 5/1982 | United Kingdom | 229/120.18 |

*Primary Examiner*—Gary E. Elkins
*Attorney, Agent, or Firm*—Dennison, Meserole, Pollack & Scheiner

[57] ABSTRACT

A two-cell carton including a first wall formed of two all panels, one of which is integral with a carton divider. The divider, from the edge of the corresponding wall panel, folds and extends transversely across the carton for bonding to a second single panel wall centrally thereof. The two wall panels include bottom flaps which combine to define a single full length locking flap.

7 Claims, 5 Drawing Sheets

SPLIT WALL CARTON

BACKGROUND OF THE INVENTION

The invention relates to two-cell cartons formed from unitary blanks of paperboard or the like.

Such cartons basically include a basket portion divided into two cells by a transverse partition or divider which in turn provides an upwardly projecting handle.

An example of a particularly acceptable form of such a carton is illustrated in prior art FIGS. 8 and 9. Of particular interest with regard to this prior art carton is the formation of the carton with the four exterior walls formed of unitary panels with the divider integral with and folded from a positioning panel which is folded into the taller cell or compartment. As such, the positioning panel provides no function other than for positioning the transverse divider.

With specific reference to FIG. 9, it will be seen that the closure flap for the taller cell is integral with one of the face panels and, in the blank, located remote from the divider and handle portion thereof. This in turn, in a two up layout for the cutting of the blanks requires a rather substantial lateral offset of adjacent blanks, and corresponding material waste.

SUMMARY OF THE INVENTION

The carton of the present invention, while quite similar in appearance to the prior art carton, and the functional equivalent thereof insofar as cell arrangement and capacity, provides unique advantages thereover. Such advantages include increased strength and stability when carried by the handle, and a substantial savings in cost due to reduction in waste and simplification in blank folding procedures.

The cost savings is a particularly significant factor when considering the vast number of such disposable cartons used, primarily in fast food industries. The savings in material is also significant in that the paperboard product, by its very nature, uses natural resources, the preservation of which is both economically and environmentally important.

As an example of the savings resulting from the carton and blank of the invention, in a two up layout there is a board saving of over 20%. This is highly significant when considering that all of the functions of the prior art carton are retained and are even enhanced with little outward change in the appearance of the carton.

In achieving the objects of the invention, the rear wall of the carton is formed by two separate wall panels, as opposed to the single panel of the prior art. One of these wall panels, of a length equal to approximately one-half the length of the carton, has the divider integral with one edge thereof for a transverse extension of the divider directly from the rear wall as the first wall panel is positioned during the folding of the carton. The second wall panel, slightly longer than the first wall panel, is folded to overlap and adhesively bond to the outer surface of the first wall panel and combined therewith in providing for a full rear wall. So constructed, the positioning panel of the prior art has been eliminated, the rear wall has been rigidified by a full height panel bonding line, and the divider is both integrally joined to the center of the rear wall and, through an adhesive flap, adhesively bonded centrally to the front wall.

The use of two panels to form the rear wall, and the elimination of the prior art positioning panel as a separate means for positioning and supporting the divider, allows for a reduction in the overall length of the blank of 3 inches when forming a standard size carton of 6.5 inches×3.25 inches×7.25 inches. Further, and particularly noticeable in the blank, the tuck style top is foldably integral with the upper edge of the first wall panel immediately adjacent the handle portion of the divider, as opposed to being remote therefrom in the prior art blank. This arrangement allows for a substantial nesting of adjacent blank patterns which is in itself significant in reducing the overall amount of paperboard required in a standard blank cutting procedure.

The invention is also concerned with a specific arrangement of the panels forming the automatically foldable bottom. In this regard, both wall panels, which together comprise the rear wall, incorporate complimentary bottom panels which interact with bottom panels provided on both the single-panel front wall and the two end walls.

Additional objects, features and advantages of the invention will become apparent from the details of construction and manner of use as more fully hereinafter presented.

DESCRIPTION OF PREFERRED EMBODIMENT

Figure 8:
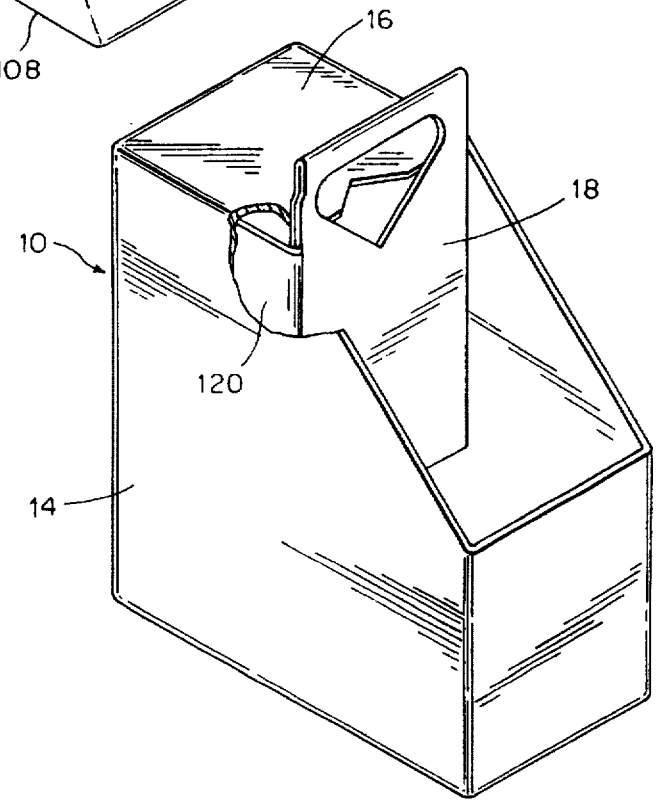
FIG. 8 PRIOR ART
FIG. 8 is a perspective view of a prior carton, with a portion broken away, wherein a separate positioning panel is used to position the divider.
Figure 9:
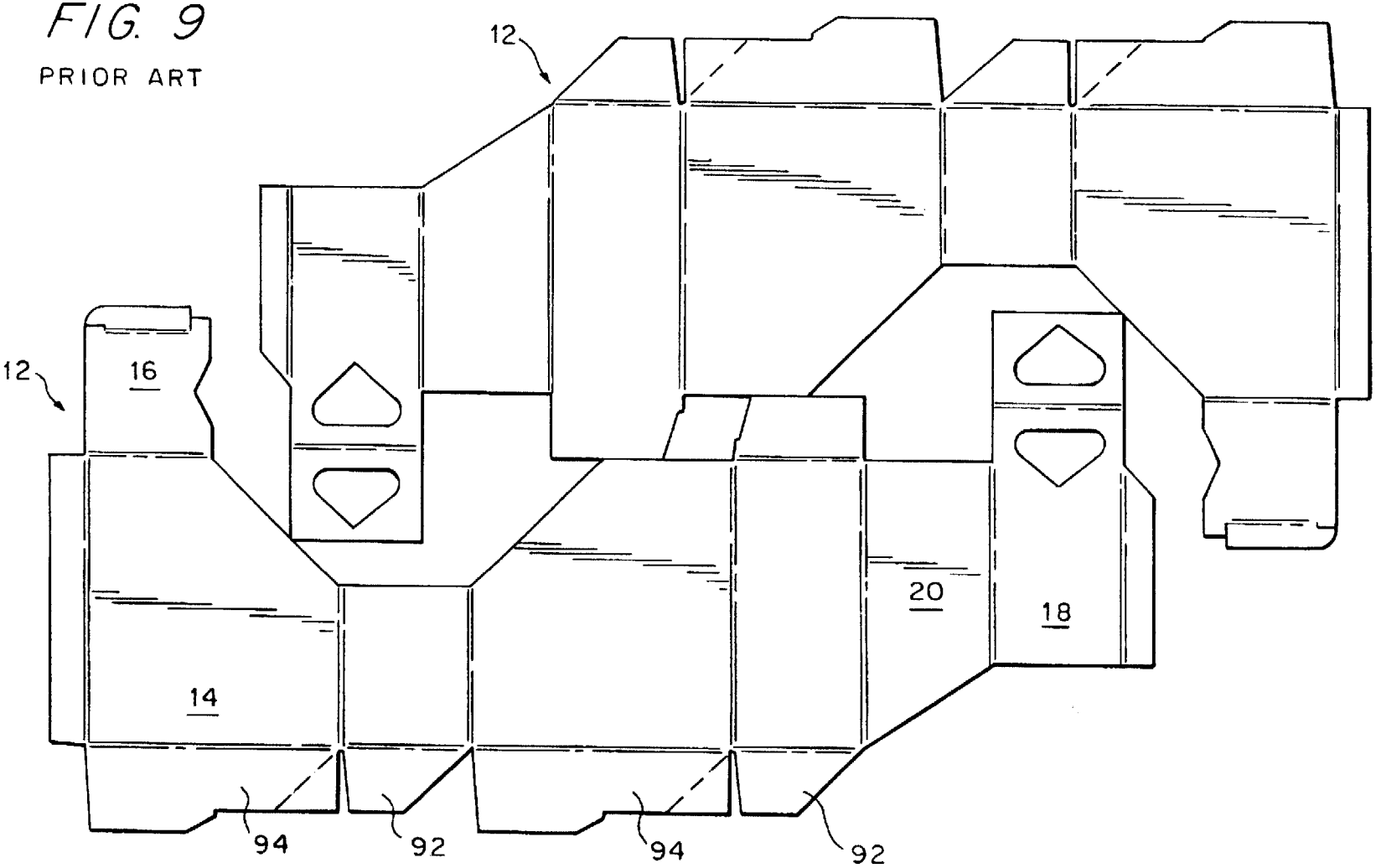
FIG. 9 PRIOR ART
FIG. 9 is a plan view of the blank from which the carton of FIG. 8 is formed, the blank being illustrated in conjunction with a similar blank in a two up layout.

In order to clearly set forth the novelty of the present invention, attention is first directed to FIGS. 8 and 9 which illustrate the prior art carton 10 and blank 12 upon which the present invention improves in a manner considered both unique and unobvious.

More particularly, it will be seen that the rear wall 14 of the carton 10 extends for the full length of the carton and includes, integral with the upper edge thereof, the closure flap 16 which is intended to fold over the open upper end of the larger or higher cell. The divider 18 of the prior art carton 10 is integral along the fold line, with a positioning panel 20 which is required to position the divider centrally of and transversely across the carton. This positioning panel 20 provides no function other than for locating the divider 18 while at the same time providing for a less than full height panel parallel to the rear wall 14 within the larger cell.

With reference to the prior art blank 12 of foldable sheet material from which the carton 10 is formed, like walls and panels have been designated by like reference numerals. Of particular interest with regard to the blank is the location of the closure flap 16, integral with the rear wall 14, at the remote end of the blank from the divider 18. So formed, the minimal layout for blank cutting in a two blank pattern requires a substantial lateral shifting of one blank relative to the other and a substantial amount of waste material.

Referring now to the carton 30 of the present invention, also of foldable sheet material such as paperboard, it will be seen that the overall appearance thereof, and hence the practical utility thereof, is similar to the prior art carton 10 of FIG. 8. However, the carton 30 of the invention differs in several significant structural or construction aspects, providing a carton with distinct economic advantages.

A particularly significant aspect of the carton 30 is the elimination of a separate positioning panel such as 20 in the carton of FIG. 8. Rather, in carton 30 the rear wall 32 is formed of two wall panels 34 and 36. The wall panel 34 is of full height and defines both the height and length of the taller cell or compartment 38. The second wall panel 36 is slightly longer than the compartment or cell 40 defined thereby, with the free vertical edge portion 42 of this panel 36 slightly overlapping, in the erected carton, the outer surface of the wall panel 34 and being adhesively bonded thereto in the manner of a glue flap. The divider 44 is integral with the wall panel 34 along a vertical fold line 46 defined along the inner edge of the wall panel 34, that edge which is overlapped by the wall panel 36 at the center of the rear wall 32. The divider 44 is of width substantially equal to the width of the first cell end wall 48 and the second cell end wall 50. The divider 44 extends transversely from the rear wall 32 to the single-panel front wall 52 and is adhesively bonded to the inner face thereof by a glue flap 54 integral with and folded from the free edge of the divider 44 remote from the fold line 46 whereat the divider is integral with the first rear wall panel 34.

It will be appreciated that the divider 44 is positioned between the rear and front walls 32 and 52 without requiring a separate positioning panel, and with the divider 44 rigidly affixed, along the opposed vertical edges thereof, directly to the rear wall 32 along fold line 46, and to the front wall 52 by the integral glue flap 54.

Further significant aspects of the invention will be appreciated from a consideration of the blank 60 from which the carton of the invention is folded. The panels of the blank 60 will be referred to by the same numbers and names given to the corresponding panels and walls in the carton 30. The blank 60 is elongate with the single-panel front wall 52, defining the length and height of the carton 30, having opposed vertical edges 62 and 64 which define fold lines for the adjacent integral end walls 48 and 50. The end walls 48 and 50 in turn have outer edges 66 and 68 which define vertical fold lines along which the rear wall panels 34 and 36 are integrally joined. The wall panel 36 is outermost at one longitudinal end of the blank 60. The first wall panel 34 has the divider panel 44 integral therewith along the fold line 46, with the divider in turn having the adhesive flap 54 extending vertically along the outer edge 70 thereof whereat a fold line is defined.

In comparing the blank 60 with the prior art blank 12, a significant difference in the overall lengths of the blanks will be noted. The endmost wall panel 36, including the adhesive area 42 thereon, is approximately one-half the length of the rear wall panel 14 and flap thereon of the prior art blank 12. In addition, the closure flap 72 is integral with the upper edge 74 of the first wall panel 34 and positioned immediately adjacent the fold-over handle flap 76 integral with the upper edge of the divider 44 along the fold line 78. A relatively shorter support flap 80 is integral with the upper edge of the end wall 48 along fold line 82.

Figure 1:
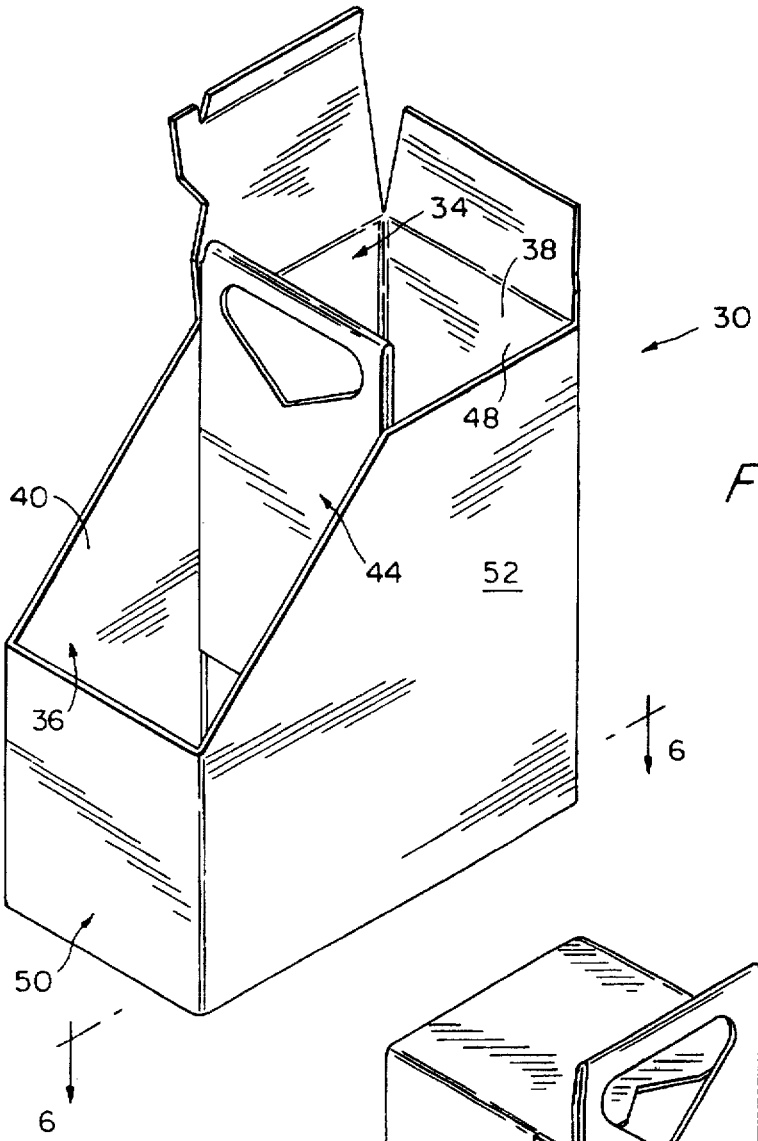
FIG. 1 is a top and front perspective view of the carton of the invention with the lid open.
Figure 2:
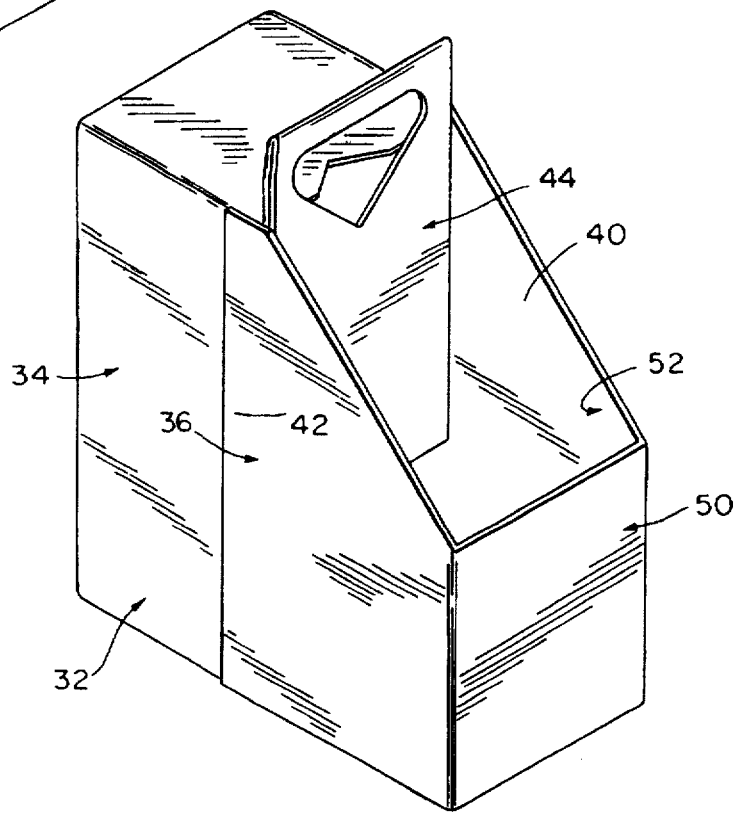
FIG. 2 is a top and rear perspective view of the carton with the lid closed and illustrating the split rear wall thereof.
Figure 3:
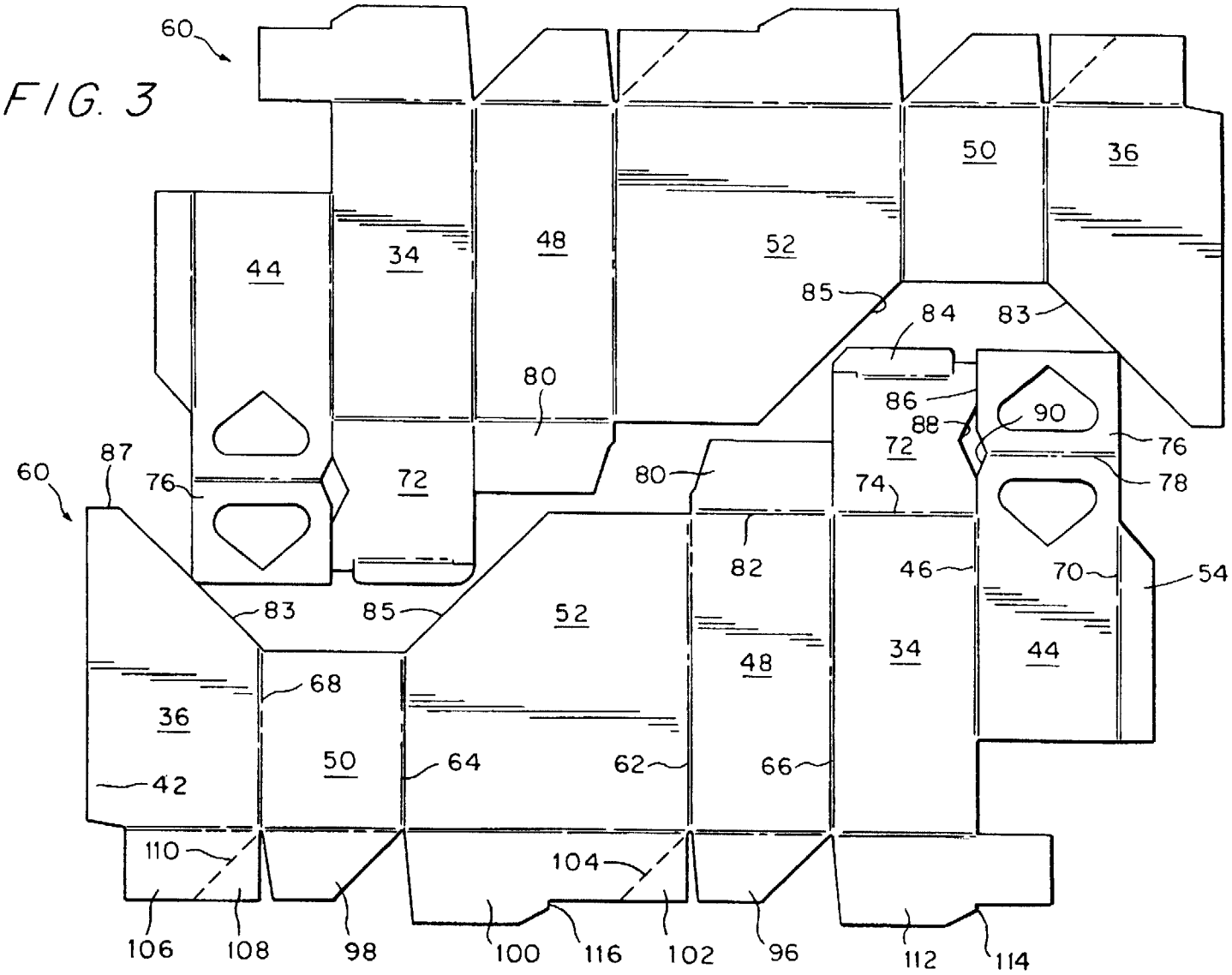
FIG. 3 is a plan view of two of the blanks, in a two up layout, used in the formation of the cartons of the invention.
Figure 4:
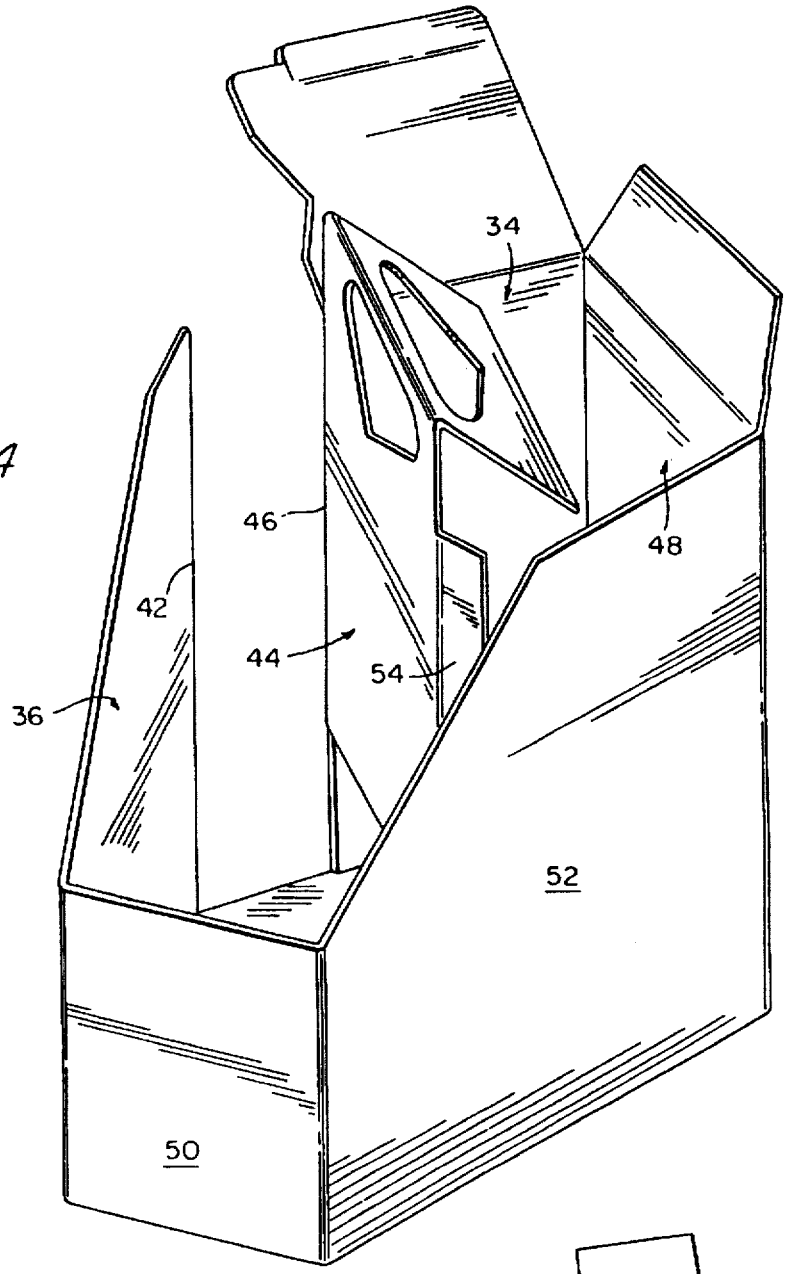
FIG. 4 is a perspective view of a partially folded blank with the divider folding inward relative to one of the wall panels forming the rear wall.
Figure 5:
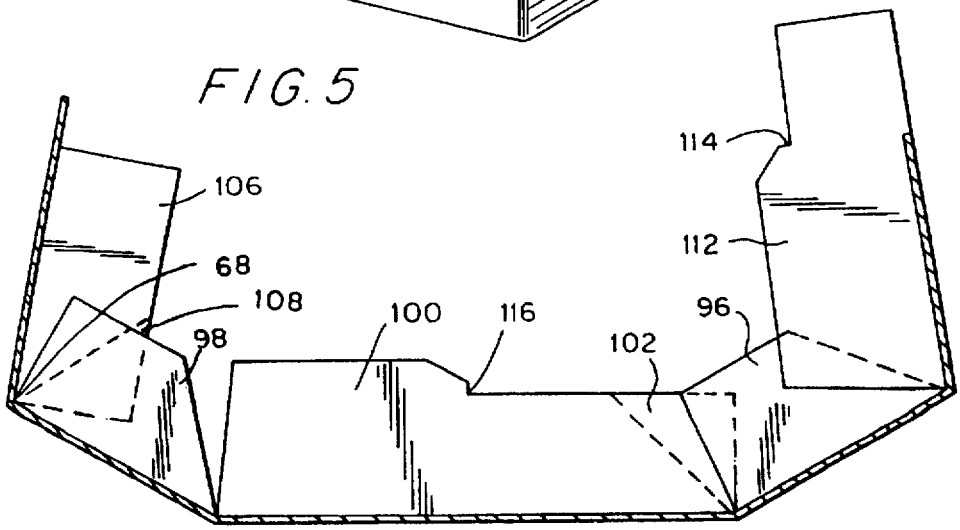
FIG. 5 is horizontal cross-sectional view through the partially folded blank below the divider and illustrating the bottom panels.

By positioning the closure lid 72, which includes an outer locking tab 84, immediately adjacent the upwardly projecting handle flap 76, and between the handle flap 76 and the support flap 80, a substantial nesting and longitudinal compacting of two adjacent blanks or blank patterns, as in the two up layout illustrated, is possible. The actual board saving in a two blank layout as in FIG. 3, relative to the prior art blanks as in FIG. 9, is over 20% for a standard size carton of 6.5 inches×3.25 inches×7.25 inches.

The nesting of the adjacent blanks 60, as compared to the prior art blanks 12 of FIG. 9, is enhanced in that the adjacent positioning of the lid or lid panel 72 and handle flap 76 allows both to be received within and take full advantage of the upper edge recess immediately above and defined by both the relatively shorter end wall 50 and the adjacent upwardly diverging upper edge lengths 83 and 85 respectively of the endmost wall panel 36 and front wall 52. In the generally similar upper edge recess portion of the prior art blank 12, little advantage is taken of the recess in light of the remote orientation of the divider 18 and closure lid 16.

As will be appreciated, the inclined edge portions 83 and 85 are utilized in forming the carton cell 40 with a progressively decreasing height between the divider 44 and end wall 50. The inclined upper edge portion 85 extends, upwardly from the end wall 50, for approximately one-half the length of the front wall 52, at which point the upper edge of the front wall 52, in the blank 60, is linearly aligned the upper edges of the end wall 48 and the rear wall panel 34, as these edges are defined by the respective fold lines 82 and 74. The inclined upper edge portion 83 of the rear wall panel 36 extends for a major portion of the length of this panel and a length equal to that of the edge portion 85, and terminates in a minor linear upper edge portion 87 which linearly aligns with the upper edge of the rear wall portion 34 and is of a length substantially equal to the length of the adhesively secured portion 42 of the panel 36.

With continued reference to the blank 60, the adjacent edges of the lid 72 and handle flap 76, as well as the upper portion of the divider 44, defined by the cut line 86, each include a notch 88 and 90 respectively defined therein. The notch 88 in the edge of the lid 72 allows for finger access to the undersurface of the lid for an opening thereof. The notch 90, defined to both sides of the handle flap 76 fold line 78, provides for a beveled corner in the vertically projecting handle portion of the divider 44, upon a folding of the handle flap 76, to avoid a projecting corner as might interfere with the closing of the lid 72. As will be appreciated from the drawings, both the handle flap 76 and the adjacent upper portion of the divider 44 have hand grip apertures therein which align upon a folding of the flap.

Referring now to the bottom of the carton 30, this bottom is a self-erecting bottom with panels which, upon an erection of the carton from its collapsed position, automatically assemble into a secure configuration capable of sustaining loads within the carton. As is conventional, the carton, after an appropriate folding and gluing of the blank, will be collapsed to lie flat for shipping and storage. When the carton is to be erected, the front and rear walls are laterally shifted to assume a laterally spaced parallel relation to each other. This also brings the end walls 48 and 50 into parallel relationship at right angles to the rear and front walls 32 and 52.

The bottom in conventional cartons, note the blank 12 of FIG. 9, is normally defined by two bottom end flaps 92 folded from the lower edges of the end walls, and two elongate locking bottom flaps 94 folded from the lower edges of the front and rear walls.

In the carton and the blank of the present invention, the end walls 48 and 50 are similarly provided with bottom flaps 96 and 98 integrally folded therefrom. The front wall 52 has a full length bottom locking flap 100 co-extensive with the lower edge of the front wall 52 and integral therewith along an appropriate fold line. The bottom flap 100, adjacent the bottom flap 96, has the corner portion 102 thereof, defined by a diagonal fold line 104, which comprises a glue flap bonded, upon a folding of the carton, to the undersurface of the end wall flap 96 across a corresponding triangular corner portion thereof.

The rear wall panel 36, at the left end of the blank 60, has a bottom flap 106 which has a similar triangular glue flap 108 defined therein by fold line 110 adjacent the end wall bottom flap 98. The glue flap 108, upon a folding of the wall panel 36 at right angles to the end wall 50, engages beneath and is adhesively bonded to a similar triangular portion of the adjacent bottom flap 98. The bottom flap 106 is rectangular and extends from the fold line 68 between the wall portion 36 and end wall 50 to the edge portion 42 of the panel 36 which is to overlap and be adhesively bonded to the corresponding wall panel 34 as previously described.

Figure 6:
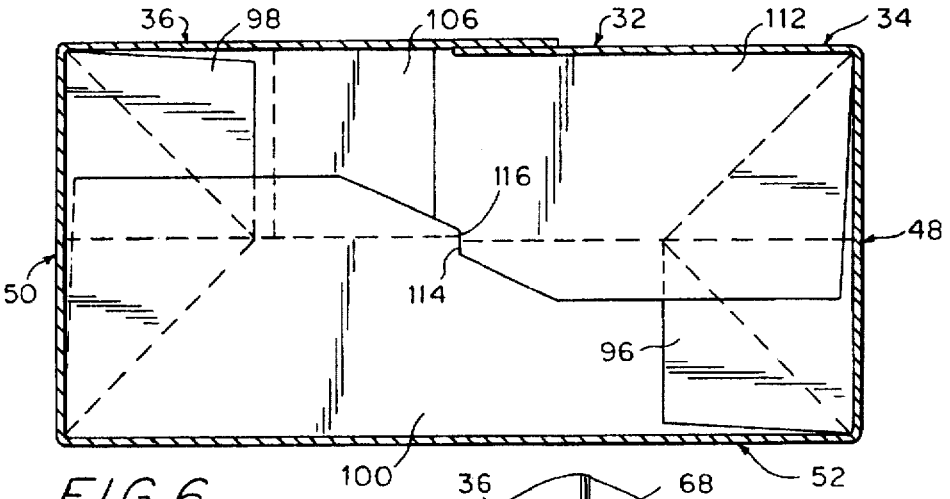
FIG. 6 is a cross-sectional view of the automatically folding bottom taken substantially on a plane passing along line 6—6 in FIG. 1.
Figure 7:
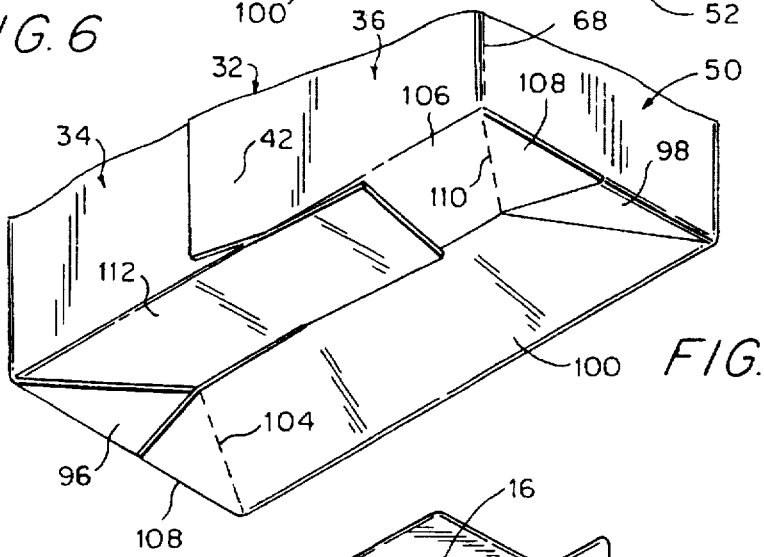
FIG. 7 is a bottom perspective view of the carton illustrating the relationship of the bottom flaps to each other just prior to a final closing.

The wall panel 34 has a bottom flap 112 integral with the lower edge thereof along an appropriate fold line and extending along the full length thereof and therebeyond into underlying relation to the shorter divider 44. In the erected carton, the extending portion of the bottom flap 112 overlies the bottom flap 106 and combines therewith in defining a locking flap co-extensive with the split rear wall 32. This two-piece rear wall bottom flap 106, 112, and the full length of flap 100, include cooperating locking shoulders 114 and 116 therein, in each case defined between relatively wider and narrower portions for a cooperating support and interlocking as suggested in FIGS. 6 and 7 and as is generally known in the art. The present invention, by utilization of the cooperating bottom flaps 106 and 112 has uniquely accommodated the split rear wall to arrive at an automatically folding bottom structure which is capable of collapsing and erecting in the manner of a standard carton bottom, notwithstanding the split wall nature of the carton 30 of the invention.

From the foregoing, it is to be appreciated that the carton and carton blank of the invention constitute a significant advance in a particularly crowded art, and a distinctly improved product which provides significant economic advantages, including a substantial reduction in board material required and an improved assembly procedure, all without in any way diminishing the strength and practicality of the finished carton.

The foregoing is illustrative of the principles of the invention. The scope of the invention is not to be limited to the specific embodiment disclosed, but rather, is to include all equivalent embodiments falling within the scope of the claims following hereinafter.

I claim:

1. For use in the formation of a two-cell carton of rectangular cross-section with a transverse divider;

an elongate blank of foldable sheet material, said blank including a central front wall panel of predetermined length and having opposed side edges, first and second end wall panels integral with said opposed side edges with a fold line defined along each side edge between said front wall panel and the corresponding end wall panel, each of said end wall panels having an outer side edge remote from said central front wall panel, first and second rear wall panels integral with the respective outer side edges of said first and second end wall panels with fold lines defined therealong, said first and second rear wall panels being of a combined length slightly greater than the length of said front wall panel wherein a co-planar positioning of the rear wall panels with a slight overlap will, in a formed carton, provide a rear wall of equal length to the length of said front wall panel, said first rear wall panel having an outer side edge remote from said first end wall panel, a divider panel integral with said outer side edge of said first rear wall panel with a fold line defined therebetween, said divider panel terminating adjacent a first outer edge of said blank, said second rear wall panel terminating at a second outer edge of said blank, said first end wall panel, said first rear wall panel and said divider panel having upper edges, a handle panel integral with said upper edge of said divider panel and extending co-planar thereto to an upper handle panel edge, a lid panel integral with said upper edge of said first rear wall panel immediately adjacent to and coplanar with said handle panel and extending upwardly from said rear wall panel and terminating in an upper lid panel edge substantially linearly aligned with said upper edge of said handle panel, said handle panel and said lid panel having adjacent side edges defined by a cut line therebetween, said front wall panel, end wall panels and rear wall panels have lower edges in a common line, said first rear wall panel and first end wall panel, and said front wall panel for a portion of the length thereof adjacent said first end wall panel being of equal height above said lower edges, said second end wall panel being of a lesser height than said first end wall panel, said front wall panel having an upper edge which is linearly aligned with the upper edge of the adjacent first end wall panel for said portion of the length of the front wall panel, said upper edge of said front wall panel being inclined downward from said portion of the length of the front wall panel to terminate at said second end wall panel, said second rear wall panel having an upper edge with a minor portion immediately adjacent said second outer edge of the blank aligned with the upper edge of the first end wall panel, and a major portion of said upper edge of said second rear wall panel being inclined downward toward and terminating at said second end wall panel, the inclined upper edge portions being opposed each other and defining an upwardly directed recess in said blank adapted to receive both the handle panel and the adjacent lid panel of a second duplicate blank positioned thereabove and inverted relative thereto.

2. The blank of claim 1 including a pair of generally opposed notches extending laterally from said cut line, one in said lid panel and one in said handle panel and extending into said divider panel.

3. The blank of claim 1 including separate bottom flaps affixed respectively to said front wall panel, end wall panels and rear wall panels along the respective lower edges thereof with a fold line defined along each lower edge, said bottom flaps on the front wall panel and the two end wall panels being co-extensive with the corresponding panels, said bottom flap on said first rear wall panel extending longitudinally beyond said first rear wall panel and in underlying relation to said divider panel in spaced relation therebelow, said bottom flap on said second rear wall panel extending from said adjacent second end wall panel to a point spaced inward from said second outer edge of said blank, said bottom flaps on said first and second rear wall panels being individually of a length less than said bottom flap on said front wall panel, and of a combined length greater than the length of said bottom flap on said front wall panel, said bottom flap of said second rear wall panel having an outer corner glue flap defined therefrom adjacent the bottom flap of said second end wall panel, and a similar outer corner glue flap defined from said bottom flap of said front wall panel adjacent the bottom flap of said first end wall panel.

4. The blank of claim 1 wherein said upper edge of said front wall panel inclines for approximately one-half the length of said front wall panel.

5. In a layout pattern, a pair of duplicate blanks for use in the formation of two-cell cartons of rectangular cross-section with a transverse divider;

said blanks being of foldable sheet material;

each said blank including a central front wall panel of predetermined length and having opposed side edges, first and second end wall panels integral with said opposed side edges with a fold line defined along each side edge between said front wall panel and the corresponding end wall panel, each of said end wall panels having an outer side edge remote from said central front wall panel, first and second rear wall panels integral with the respective outer side edges of said first and second end wall panels with fold lines defined therealong, said firsthand second rear wall panels being of a combined length slightly greater than the length of said front wall panel wherein a co-planar positioning of the rear wall panels with a slight overlap will, in a formed carton, provide a rear wall of equal length to the length of said front wall panel, said first rear wall panel having an outer side edge remote from said first end wall panel, a divider panel integral with said outer side edge of said first rear wall panel with a fold line defined therebetween, said divider panel terminating adjacent a first outer edge of said blank, said second rear wall panel terminating at a second outer edge of said blank, said first end wall panel, said first rear wall panel and said divider panel having upper edges, a handle panel integral with said upper edge of said divider panel and extending co-planar thereto to an upper handle panel edge, a lid panel integral with said upper edge of said first rear wall panel immediately adjacent to and coplanar with said handle panel and extending upwardly from said rear wall panel and terminating in an upper lid panel edge substantially aligned with said upper edge of said handle panel, said handle panel and said lid panel having adjacent side edges defined by a cut line therebetween;

one of said pair of duplicate blanks being in a position rotated 180° relative to a second of said pair of blanks with the handle panel and lid panel of each blank aligned with the second end wall panel of the other blank and received generally between said front wall panel and said second rear wall panel of the other blank.

6. The layout pattern of claim 5 wherein, in each blank, said front wall panel, second end wall panel and second rear wall panel each have an upper edge, the upper edges of said front wall panel and said second rear wall panel being inclined upward and in opposite directions from the upper edge of said second end wall panel and defining an upwardly directed recess in said blank within which both the handle panel and the adjacent lid panel of a second duplicate blank, positioned thereabove and inverted relative thereto, is received.

7. The layout pattern of claim 6 wherein said inclined upper edge of said front wall panel extends for approximately one-half the length of said front wall panel, and said inclined upper edge of said second rear wall panel extends for a major portion of the length of said second rear wall panel, said inclined edges being of substantially equal length.

* * * * *

UNITED STATES PATENT AND TRADEMARK OFFICE

CERTIFICATE OF CORRECTION

PATENT NO. : 5,775,574

DATED : July 7, 1998

INVENTOR(S) : SIMON WHITNELL

It is certified that error appears in the above-indentified patent and that said Letters Patent is hereby corrected as shown below:

Column 7, line 29, "firsthand" should read --first and--

Signed and Sealed this

Twenty-second Day of September, 1998

*Attest:*

Bruce Lehman

BRUCE LEHMAN

*Attesting Officer*

*Commissioner of Patents and Trademarks*